United States Patent [19]

Bothner

[11] Patent Number: 4,903,083

[45] Date of Patent: Feb. 20, 1990

[54] SIMPLIFIED CLEANING WEB APPARATUS

[75] Inventor: Carl R. Bothner, Rochester, N.Y.

[73] Assignee: Eastman Kodak Company, Rochester, N.Y.

[21] Appl. No.: 225,447

[22] Filed: Jul. 28, 1988

[51] Int. Cl.[4] ..... G03G 21/00

[52] U.S. Cl. ..... 355/300; 15/1.5 R; 355/296

[58] Field of Search ..... 355/296, 300, 297, 298, 355/213; 15/1.5 R

[56] References Cited

U.S. PATENT DOCUMENTS

| | | | |
|---|---|---|---|
| 3,190,198 | 6/1965 | Eichorn | 355/300 |
| 3,641,605 | 2/1972 | Lindsay | 355/296 X |
| 3,829,208 | 8/1974 | van Meijel et al. | 355/213 |
| 3,975,096 | 8/1976 | Opravil | 355/300 |
| 4,110,035 | 8/1978 | Kamata | 355/300 |

FOREIGN PATENT DOCUMENTS

| | | | |
|---|---|---|---|
| 7414374 | 1/1975 | Netherlands | 355/296 |

*Primary Examiner*—A. T. Grimley
*Assistant Examiner*—Thu A. Dang
*Attorney, Agent, or Firm*—Tallam I. Nguti

[57] ABSTRACT

A cleaning web apparatus includes a housing for holding web material that is used in cleaning a surface of a moving image-bearing member. The housing is supported operationally adjacent the image-bearing member such that the outside surface of the housing frictionally contacts the surface being cleaned. The web material inside the housing is incrementally advanced over the outside surface of the housing, which also serves as a fixed axis for keeping the web material against the surface being cleaned.

12 Claims, 4 Drawing Sheets

SIMPLIFIED CLEANING WEB APPARATUS

BACKGROUND OF THE INVENTION

This invention relates to electrostatographic process equipment and, more particularly, to a web apparatus for cleaning toner and other particles from a surface of an image-bearing or other member in such equipment.

Electrostatographic process equipment produce or reproduce desired toned images on an insulated image-bearing surface by employing electrostatic charges and toner through a repeatable cycle. A typical cycle includes the steps of (1) using electrostatic charges in some manner to form an electrostatic image on the image-bearing surface; (2) developing this image with particles of toner; (3) transferring the toned image to a receiver; and (4) cleaning residual toner and other particles from the front and backside surfaces of the image-bearing member in preparation for repeating the cycle. The quality of images obtained by repeating these steps depends significantly on the ability to clean these surfaces.

The cleaning step is, therefore, very important and has led to the development of many cleaning methods and apparatus. One such method and apparatus utilizes a web of fibrous material such as paper towelling to contact and wipe residual toner and other particles from a surface of the image-bearing member.

Conventionally, this method and apparatus includes three rolls. Typically, these are a supply roll that holds and supplies unused web material, a pressure roll that presses the web material into contact with the surface being cleaned, and a take-up roll for the used web material. These three rolls usually are on three separate axes, each requiring separate mechanical supports, and sometimes even drive means, thereby adding to the complexity of the system. The pressure roll, by bringing the web material into contact with the surface to be cleaned, in addition, has a tendency for introducing undesirable normal forces into the surface, especially when the surface is the front or backside of a photoconductive belt.

SUMMARY OF THE INVENTION

The present invention simplifies the design of a web material cleaning apparatus by reducing the number of required axes and parts, and by eliminating the undesirable normal forces of a pressure roll.

In accordance with the preferred embodiments of the present invention, a housing supported by means adjacent the surface to be cleaned, is in contact with such surface. The housing holds a roll of clean web material that is incrementally advanced out of, and over the outside surface of the housing and onto a take-up means for disposal. The housing, in addition, serves as a fixed axis for keeping the advancing web material in intimate contact with the surface to be cleaned, and the take-up means further includes a take-up core that is pre-attached to the loose end of the web material ready for manual coupling to a rotatable drive pin.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENTS

The present invention will now be described with reference to its preferred embodiments as a surface cleaner in an electrostatographic apparatus such as an electrophotographic copier or printer 10.

Figure 1:
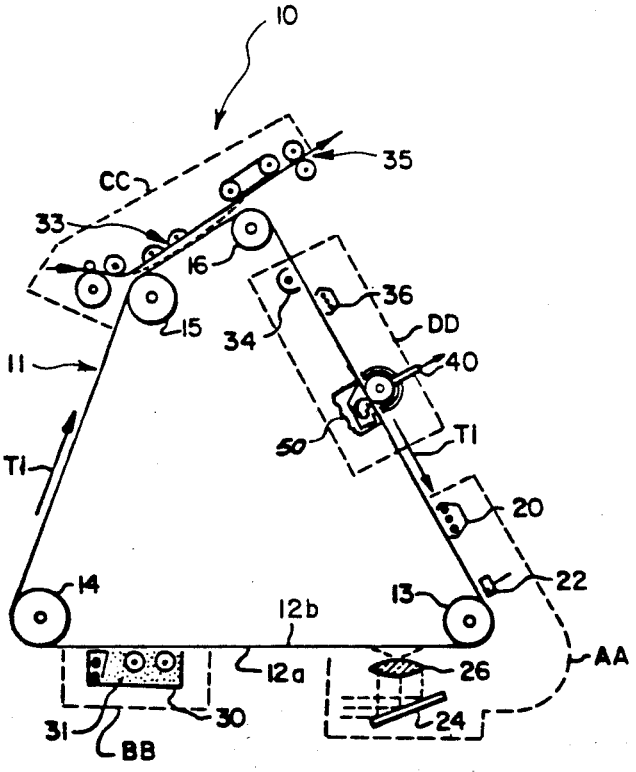
FIG. 1 is a schematic view of the image loop of an endless belt image-bearing member type copier or printer incorporating the present invention as a backside cleaner.

An electrostatographic copier or printer includes an image-bearing member which can be a rigid drum or a continuous web. Referring to FIG. 1, the copier or printer 10 includes the image-bearing member 11 that is shown in the form of an endless belt and that has an image-bearing surface 12*a* and a backside surface 12*b*. Member 11 is trained about rollers 13 through 16 for movement in the direction indicated by the arrows T1, past a series of operating stages AA, BB, CC and DD. One roller such as roller 13, can be a drive roller.

Initially, clean and charge-free portions of the image-bearing member 11 with surfaces 12*a*, 12*b*, move through stage AA where electrostatic charges and/or light, are used in one manner or another (as is well known in the art) to form electrostatic images on each such portion. Typically, stage AA includes components such as the primary charger 20 or other charge depositing component (not shown). The electrostatic image can be formed, for example, by charging the surface 12*a* using the primary charger 20, and then selectively discharging portions of it by using an electronic print head 22 and/or by using an optical system. A typical optical system has a light source (not shown) that illuminates a document sheet with light rays from the sheet being reflected by a mirror 24 through a lens 26 to the surface 12*a*. This portion of the image-bearing member 11 carrying the electrostatic image next moves to stage BB where the electrostatic image is developed with particles of toner.

Stage BB normally includes a development station 30 that contains a developer material 31. The development material can be made up of toner particles only, or of a mixture of carrier particles and toner particles. During development, toner particles adhere to the electrostatic image on the image-bearing surface 12*a*, thus making the image visible. Although undesirable, some toner particles somehow also find their way to the backside 12*b*. After development, this portion of the image-bearing member 11 carrying the developed image on surface 12*a* next moves to stage CC.

Stage CC usually includes an image transfer station 33 where the visible toner image on surface 12*a* is transferred to a suitable receiver such as a sheet of paper that is fed in registration to station 33 along a sheet travel path. After such transfer, the copy sheet then travels to a fusing station 35 where the transferred image is permanently fused to the copy sheet.

During the transfer of the toner-particle image from the surface 12*a* to the copy sheet, some of the toner particles will remain adhered as residue to the surface 12*a*. The backside 12*b*, in addition, will have been exposed to airborne particles and other contamination within the copier or printer. Other contamination on the backside 12*b*, of course, comes from the development station 30 and from the rollers 13 to 16. Image quality during subsequent cycles of the imaging process, is enhanced if such residual particles and other contamination are removed from these portions of the surfaces 12*a*, 12*b* of the image-bearing member 11 before the portions again go through image formation, development and transfer.

At the next stage DD, such removal is accomplished on the front surface 12*a* by a cleaner 40 and on the backside 12*b* by a backside cleaning apparatus, generally designated as 50.

Referring now to FIGS. 2, 3, 4 and 5, the cleaning apparatus 50 which is suitably adapted for cleaning the backside 12*b* of an endless belt-type, image-bearing member, comprises an elongate housing in the form of a tube 52 that is easily loaded on, and unloaded from front and rear mechanism plates 54, 55. Plates 54, 55 are located and spaced a distance slightly greater than the width of the image-bearing member 11. Each plate has a cutout 56 and 57, respectively, for holding and locking the tube 52 in a position from which the tube frictionally contacts the back surface 12*b* of the member 11. Appropriate support plates can also be utilized for holding and locking the tube 52 in a position from which the tube frictionally contacts the image-bearing surface 12*a*. In this latter arrangement, the apparatus 50 will function as a frontside, not a backside cleaner.

Figure 3:
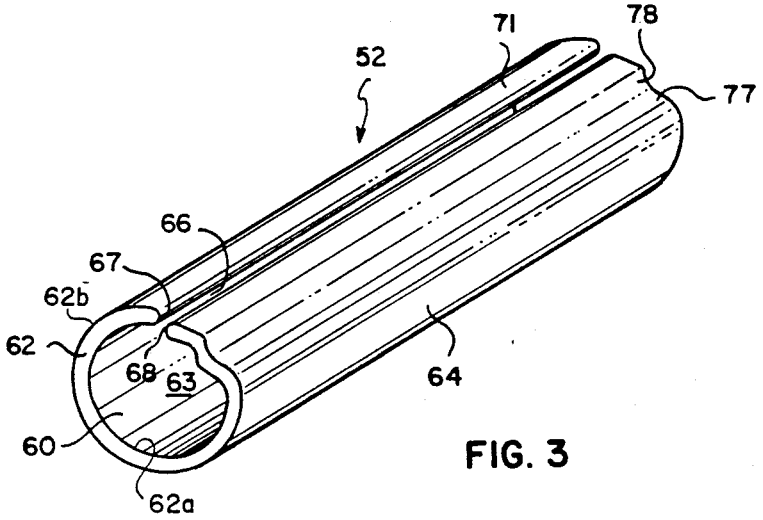
FIG. 3 is a perspective view of the housing of the present invention in the form of a tube.

As shown in FIG. 3, tube 52 consists of a thin but rigid shell 62 having an inner wall 62*a*, an outer wall 62*b*, and open ends 60, 61. The inner wall 62*a* defines an inside chamber 63, and the outer wall 62*b* defines an outside surface 64. The shell 62 also has an opening therein in the form of a longitudinal slot 66 communicating with the chamber 63. The slot 66 is defined by first and second edges 67, 68 of which edge 67 is smooth and rounded to adjoin the outside surface of an adjacent arc portion 71 of the shell 62. The arc portion 71 may be of a greater radius than the rest of the shell 62, or it may be slightly flattened to increase the area of contact with the surface 12*b*. The second edge 68 adjoins a second arc portion 75 that has formed therein a detent defined by a small flat step 77 and a riser 78. The detent is suitable for locking the tube 52 against rotation caused by a web material 80 being pulled over the first edge 67 from a roll 81 located within the chamber 63.

The arc portion 71 which forms a fixed axis over which the web material 80 moves, normally is in contact with the surface 12*b*. It therefore does not operate to bring the web 80 to the surface 12*b*, but merely to keep the web 80 against such surface. As such, it does not introduce varying normal forces to the member 11.

To load the tube 52, the roll 81 is simply placed within the chamber 63, and the tube 52 is positioned in the cut outs 56, 57 and rotated in the direction of the arrow L (FIG. 5) until the step 77 and riser 78 lock against the lips of the cut outs 56, 57. When loaded as such, the arc portion 71 of the shell 62 sits higher than the tops of the plates 54, 55, and frictionally contacts the surface 12*b* of member 11. The tube 52 may be loaded as such during scheduled service when the member 11 is removed from the copier or printer. Alternatively, however, only the roll 81 may need to be replaced after an initial loading of the roll 81 and tube 52. When this is the case, a new roll 81 is simply inserted into the chamber 63 through the front end 60 of the tube 52 already in place.

The roll 81 which has a rolled up end 83 and a loose end 84, is preferably coreless since it requires no mounting within the chamber 63. One advantageous feature of the present invention, is the fact that the roll 81 is simply placed, not mounted, within the chamber 63 and in such a way that it can be unwrapped by pulling the loose end 84. The web material 80 of roll 81 typically is about 10 mil thick and can be made of a non-woven rayon fabric, paper towelling or other similar material.

Figure 2:
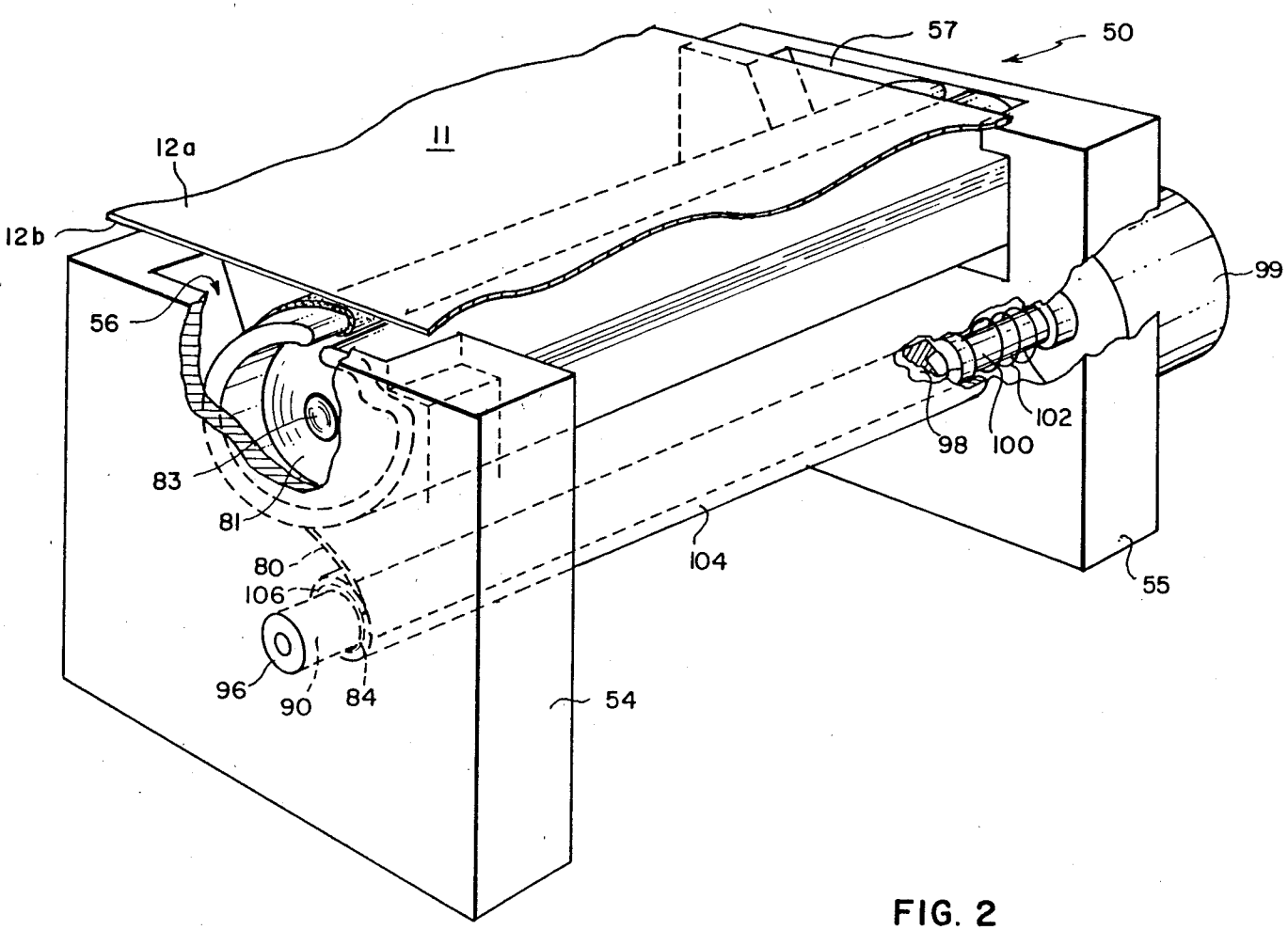
FIG. 2 is a perspective view of the present invention supported for cleaning the backside of an endless belt image bearing member.
Figure 4:
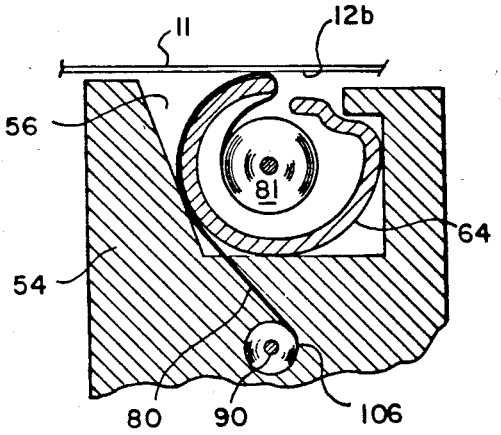
FIG. 4 is a detailed end view, partly in section, showing the present invention.
Figure 5:
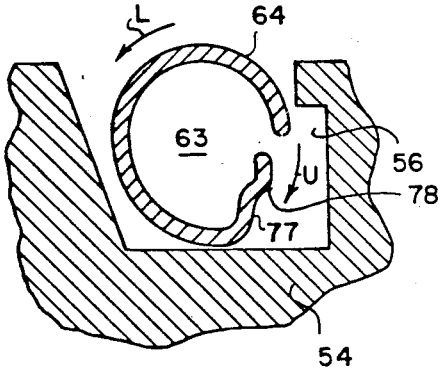
FIG. 5 is a sectional end view of the housing of the present invention illustrating the easy loading, locking and unlocking features.

With roll 81 placed within the chamber 63, the loose end 84 is trained out of the tube 52, through the slot 66, and in a direction opposite to the direction of travel of the image-bearing member 11. The end 84 is then pulled over the first edge 67, forcibly over the arc portion 71 where it frictionally contacts the surface to be cleaned or (as shown in FIGS. 2 AND 4), the backside 12*b* of member 11. It is then pulled over the outside surface 64 of the shell 62 and tangentially away from the surface 64 for attachment to a take-up core 90.

In a varied embodiment, the tube 52 can also be adapted so that the apparatus 50 can be suitably used to clean the surface of a rigid drum type image-bearing member or the surface of a roller.

Figure 6:
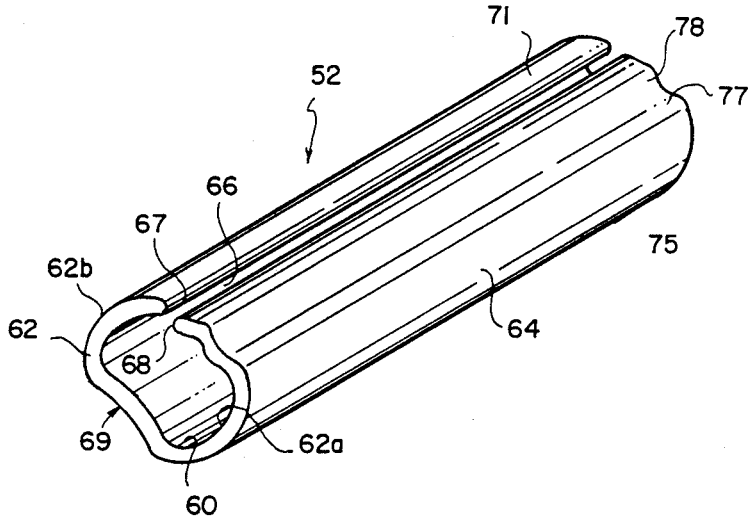
FIG. 6 is a perspective view of the housing of the present invention adapted for cleaning the surface of a rigid drum or roller.
Figure 7:
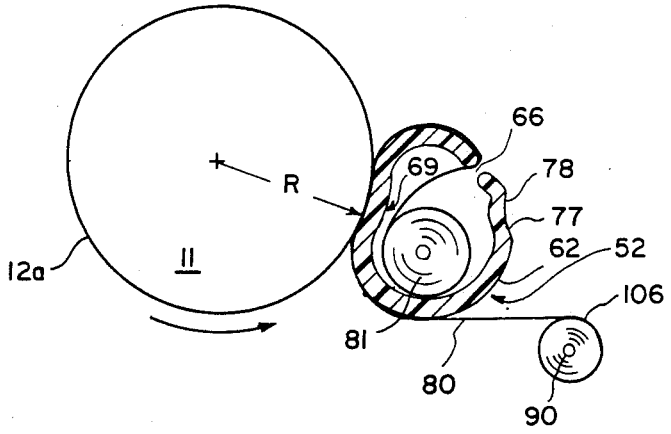
FIG. 7 is a schematic end view showing the housing of FIG. 6 in cleaning engagement with a drum or roller type surface.

In this particular embodiment as shown in FIGS. 6 and 7, the cleaning apparatus 50 comprises an elongate housing in the form of a tube 52 that can be mounted operatively in contact with the surface 12*a* of a rigid drum type image-bearing member 11. The tube 52 consists of a thin but rigid shell 62 having an inside wall 62*a*, an outside wall 62*b*, and open ends 60, 61. The inside wall 62*a* defines an inside chamber 63, and the outside wall 62*b* defines an outside surface 64. The shell 62 has an opening therein in the form of a longitudinal slot 66 communicating with the chamber 63. The slot 66 is defined by a smooth and rounded first edge 67, and a second edge 68. The first edge 67 adjoins an adjacent arc portion 71 of the shell 62. The second edge 68 adjoins a second arc portion 75 that has formed therein, a detent defined by a small flat step 77 and a riser 78.

Between the arc portions 71 and 75, the shell 62 includes a reverse radius curvature 69 adapted to follow and fit against the surface 12*a* of the drum image-bearing member 11. The reverse radius of the curvature 69 is therefore substantially the same as the radius R of the drum member 11. When the tube 52 is loaded operatively against the drum member 11, the curvature 69 will ordinary contact and ride over the surface 12*a*. In this embodiment, the area of contact between the curvature 69 and the surface 12*a* forms the cleaning zone. A roll 81 of web cleaning material 80 placed within the chamber 63 as described above, is similarly trained over the outside surface 64, pulled over the curvature 69 thereby frictionally contacting the surface 12*a*, and then tangentially away for attachment to the take-up core 90.

The take-up core 90 which is the same regardless of the surface being cleaned, is cylindrical and has front and rear ends 96, 98. Front end 96 is supported rotatably on a front support, for example, on the front plate 54, while the rear end 98 is adapted for coupling frictionally to a drive means 99 via a spring loaded drive pin 100. The pin 100 is connected to the drive means 99 and passes through the rear mechanism plate 55 where it is supported rotatably. In addition, pin 100 is forward loaded and constrained by a spring 102 to facilitate coupling with the take-up core 90. Meanwhile, the take-up core 90 which can be released from its frontwards constraint by pulling the drive pin 100 axially backwards and away from the core itself, is axially constrained by an 'E' ring 104 for proper tracking of the web 80.

The manner in which the cleaning apparatus 50 operates will now be described. As each contaminated portion of the moving member 11 enters the area where it will be cleaned, the surface to be cleaned frictionally contacts the web material 80. When used as a backside cleaner as shown in FIGS. 2, 3 and 4, the backside **12*b* contacts the web 80 as the web moves over the arc portion 71. In FIG. 7 the surface 12*a* of the drum or roller contacts the web 80 within the reverse radius curvature 69. During such contact, the web material 80, which is either stationary or is being advanced in a direction opposite to that of the moving member 11**, frictionally dislodges toner and other contaminating particles from the surface being cleaned. Simultaneously, the web material captures such particles within the fibrous structure of that section of the web that is in cleaning contact with the surface being cleaned.

As sections of the web material that are in cleaning contact with such surface become saturated with dislodged particles, the drive means 99 is activated for a brief period to incrementally move the drive pin 100 in a take-up direction, which is clockwise, as shown in FIGS. 2, 4 and 7. The driven pin 100 rotates the take-up core 90 causing the loose end 84 of the web material 80 to wrap around the core 90 thus forming the take-up roll 106. This wrapping of the loose end 84, and subsequently of used sections of the web material 80, correspondingly advances clean and unsaturated sections of the web material 80 from the roll 81 within the chamber 63, into the cleaning zone. The frequency and rate at which the web material is so incrementally advanced may be predetermined and built into the drive means 99.

When the coreless roll 81 of clean web material 80 within the chamber 63 is completely used up, it of course becomes the roll 106 of spent material on the take-up core 90 which is then removed and thrown away. To remove the spent roll 106, the drive pin 100 is pulled axially backwards releasing the take-up core 90. If the tube 52 is to be unloaded from its operative position in contact with the surface being cleaned, it is simply rotated in the direction shown by the arrow U (FIG. 5), and then lifted out of the cut outs 56, 57, for example. A new roll 81 of clean web material is again simply placed, unmounted, within the chamber 63 of the tube 52 that is to be reloaded. Where the tube 52 is not to be unloaded, a new roll 81 is simply inserted into the chamber 63 through the open end 60 of the tube already in place. In either case, the loose end 84 of the roll 81 is then appropriately trained and attached to a new take-up core 90 for coupling to the drive pin 100, again readying the cleaning apparatus 50 for cleaning the surface against which it is supported.

Although the above, detailed description has been made with particular reference to preferred embodiments, it will be understood that variations and modifications can be effected within the spirit and scope of the simplified cleaning web apparatus of the present invention.

What is claimed is:

1. A device for holding cleaning web material in a web apparatus for cleaning a surface of an image-bearing or other member in a copier or printer, the device including:

a. an elongate housing having an outside wall and an inside wall;

b. a chamber defined by said inside wall of said housing for receiving and holding a roll of the cleaning web material;

c. means associated with said housing for permitting insertion of the roll of cleaning web material into said chamber;

d. a longitudinal slot formed through said housing communicating with said chamber for receiving web material pulled out in sheet form from the roll within said chamber; and e. retaining means associated with said housing for keeping the web material in sheet form in frictional contact against the surface to be cleaned.

2. The invention as set forth in claim 1 wherein said means for permitting insertion of the roll of web material in said chamber is an open end of said housing.

3. The invention as set forth in claim 1 wherein said retaining means is a reverse radius curvature in said housing, said curvature being suitable for retaining the web material in frictional contact with a curved surface to be cleaned.

4. The invention as set forth in claim 1 wherein said retaining means is a longitudinal portion of said outside wall of said housing.

5. The invention as set forth in claim 1 further including means for locking said housing in a mounted operative position adjacent the surface to be cleaned.

6. The invention as set forth in claim 1 wherein said housing is a generally cylindrical shell.

7. The invention as set forth in claim 1 wherein said retaining means is a longitudinal portion of said outside wall of said housing.

8. The invention as set forth in claim 5 wherein said locking means is a detent in said outside wall of said housing.

9. A cleaning apparatus for removing toner and other particles from a surface of a moving image-bearing or other member in a copier or printer, the apparatus comprising:

a. a cleaning web cartridge including (1) a roll of unused cleaning web material, (2) a housing having an outside wall and an inside wall defining a chamber suitable for holding said roll of web material, as well as a longitudinal slot therein for receiving web material unwrapped from said roll in said chamber, and (3) a take-up core for receiving web material unwrapped from said roll in said chamber;

b. means for supporting said cartridge adjacent the surface to be cleaned such that a portion of said web material, unwrapped and trained through said slot and over said outside wall, is in cleaning contact with the surface to be cleaned; and c. drive means including a drive pin which is coupled to said take-up core for incrementally advancing said web material out of said chamber.

10. The invention as set forth in claim 8 wherein said drive pin is forward-loaded by a spring to facilitate quick manual coupling and uncoupling of said take-up core.

11. The invention as set forth in claim 8 wherein said take-up core is radially constrained by an 'E' ring for proper tracking of said web material being advanced by said take-up core.

12. The invention as set forth in claim 8 wherein said roll of unused web material is coreless.

* * * * *